US012029371B2

(12) United States Patent
Di Lillo

(10) Patent No.: US 12,029,371 B2
(45) Date of Patent: Jul. 9, 2024

(54) DISHWASHING APPARATUS AND METHOD

(71) Applicant: Michael Di Lillo, Laval (CA)

(72) Inventor: Michael Di Lillo, Laval (CA)

( * ) Notice: Subject to any disclaimer, the term of this patent is extended or adjusted under 35 U.S.C. 154(b) by 277 days.

(21) Appl. No.: 17/439,057

(22) PCT Filed: Mar. 12, 2020

(86) PCT No.: PCT/CA2020/050331

§ 371 (c)(1),
(2) Date: Sep. 14, 2021

(87) PCT Pub. No.: WO2020/186344

PCT Pub. Date: Sep. 24, 2020

(65) Prior Publication Data

US 2022/0151455 A1 May 19, 2022

Related U.S. Application Data

(60) Provisional application No. 62/819,836, filed on Mar. 18, 2019.

(51) Int. Cl.
*A47L 15/24* (2006.01)
*A47L 15/50* (2006.01)

(52) U.S. Cl.
CPC ..... *A47L 15/242* (2013.01); *A47L 15/247* (2013.01); *A47L 15/501* (2013.01)

(58) Field of Classification Search
CPC .... A47L 15/246; A47L 15/242; A47L 15/241; A47L 15/245; A47L 2401/28; A47L 2501/24
See application file for complete search history.

(56) References Cited

U.S. PATENT DOCUMENTS 3,312,230 A 4/1967 Thring
3,384,097 A 5/1968 Meeker et al.
(Continued)

FOREIGN PATENT DOCUMENTS

CA 2184723 A1 9/1995
CA 2233404 A1 9/1999
(Continued)

OTHER PUBLICATIONS

European Search Report issued on European Patent Application No. 20772763.7 dated Nov. 11, 2022; pages.
(Continued)

*Primary Examiner* — Michael E Barr
*Assistant Examiner* — Irina Graf
(74) *Attorney, Agent, or Firm* — Miltons IP/p.i.

(57) ABSTRACT

A dishwashing apparatus comprises a housing containing a series of zones, each zone adapted for performing a step of a dishwashing cycle. A drive means transports a shuttle loaded with a soiled item in a loop from a loading/unloading area atop the housing, into the housing, through each of the wash-step zones and out of the housing back to the loading/unloading area. Different shuttle types are provided, each type adapted to carry one of: an individual item of plateware, an individual item of cupware or an individual place setting of cutlery. A method of washing dishes utilising the apparatus is described. The apparatus is compact for installation flush with countertop adjacent to a kitchen sink. The apparatus and method permit rapid and efficient washing of small numbers of items such as a single place setting.

6 Claims, 5 Drawing Sheets

(56) References Cited

U.S. PATENT DOCUMENTS

| | | | | |
|---|---|---|---|---|
| 3,942,545 | A | 3/1976 | Flynn | |
| 8,491,723 | B2 | 7/2013 | Lehmann | |
| 8,746,262 | B2 | 6/2014 | Disch et al. | |
| 2013/0240001 | A1 * | 9/2013 | Padtberg | A47L 15/241 134/127 |

FOREIGN PATENT DOCUMENTS

| | | | |
|---|---|---|---|
| CN | 105167727 | A | 12/2015 |
| CN | 108403054 | A | 8/2018 |
| DE | 476329 | C1 | 5/1929 |
| IT | 20090002 | A1 | 3/2011 |
| JP | S6167661 | U | 5/1986 |
| WO | 2004045360 | A1 | 6/2004 |
| WO | WO-2016111648 | A1 * | 7/2016 |

OTHER PUBLICATIONS

International Search Report for International Patent Application No. PCT/CA2020/050331 dated Jun. 2, 2020; 5 pages.

* cited by examiner

DISHWASHING APPARATUS AND METHOD

BACKGROUND TO THE INVENTION

The invention relates to automated cleaning of kitchenware. More particularly, the invention relates to a dishwashing apparatus and method for washing dishes/tableware.

Dishwashers, i.e. machines for washing dishes and the like, have been available since the 1950's, however these devices have largely been of the same type and configuration, namely a chamber in which the soiled items are battered with water and detergent.

Currently available domestic dishwashers are most effective and efficient when used to wash a full load, which may represent a significant number of items. These machines are inappropriate for cleaning a small number of items, such as those produced by one or two people from a small meal or snack. Accordingly, most users wait to fill the machine and run it when full, once a day or once every couple of days. While the dishwasher is filled, the soiled items either dry out, so that the soil material dries onto the items making it more difficult to subsequently wash off, or mold over, creating an unsightly and unsanitary mess. To mitigate these disadvantages, soiled items may be pre-rinsed prior to loading but this additional manual step is inconvenient and tends to obviate the advantage of having a dishwasher in the first place.

Domestic dishwashing machines are commonly installed under a kitchen counter with a front-facing door, hinged at the bottom. Consequently, loading and unloading the machine presents an open door below knee level and requires the user to bend over, an awkward and potentially hazardous process.

Dishwashing machines for commercial applications such as restaurants and cafeterias have employed continuous conveyors to transport articles to be washed through various wash steps. For example, GB 1023772 A (Thring) describes a dishwashing machine in which articles to be washed are loaded into a loose basket which is conveyed through a downward washing run and an upward drying run. Each basket has mesh sides and a tray bottom for receiving miscellaneous charges of dishes, utensils and cutlery. DE 476329 C1 (Gustav) describes a dishwashing machine in which suspended crockery baskets are conveyed through a pre-washing vessel and a spray chamber. A pivoting movement is transmitted to the crockery baskets in order that water spray jets may impact all parts of dishes placed in the crockery baskets. GB 190921745 A (Jones) describes a machine for washing plates in which plates are secured in holders attached to a conveyor which carries the plates through tanks of water and past rotary brushes. These machines are far to large, complex and costly for domestic use.

There remains a need for a fully automated dishwashing machine that is compact, economical, easy to use and capable of washing small numbers of items such as plates, cups and cutlery quickly and efficiently.

Glossary

For a clear understanding of the invention, certain terms used in the following description are defined below:

"Cupware" means cups, glasses and the like. The term is not intended to be restricted to any particular style or category of drinking vessel. Reference to cups should be taken to include glasses and vice versa.

"Cutlery" includes items of cutlery such as knives, forks and spoons as well as other hand held kitchen utensils such as peelers, mashers, whisks etc. Reference to cutlery should be taken to include utensils and vice versa, unless ruled out by the context.

"Glassware" is synonymous with Cupware.

"Place-setting". A Place-setting of cutlery refers to one or more items of cutlery used by one person during a meal and may include the items of cutlery customarily laid or set at table for a meal for one person. The exact composition of a place-setting may vary according to the meal to be served/eaten, but usually includes a knife, a fork and a spoon. Supplementary items may be laid for a formal meal. A snack may entail the use of fewer items of cutlery.

"Plateware" means plates, bowls and the like. Reference to plates should be taken to include any item of plateware unless ruled out by the context.

"Tableware" includes Plateware, Cupware and Cutlery.

SUMMARY OF THE INVENTION

Accordingly, in a first aspect, the invention provides a dishwashing apparatus comprising:

- a housing containing a series of zones, each zone adapted for performing a step of a dishwashing cycle;
- a loading/unloading area atop the housing;
- a plurality of shuttles for receiving and conveying soiled items, the shuttles disposed in sets comprising:
  - a set of plateware shuttles, each plateware shuttle configured to receive and carry an individual item of plateware,
  - a set of cutlery shuttles, each cutlery shuttle configured to receive and carry an individual place-setting of cutlery and/or utensils,
  - a set of cupware shuttles, each cupware shuttle configured to receive and carry an individual item of cupware;

and

- a drive means for transporting a shuttle loaded with a soiled item in a loop from the loading/unloading area into the housing, through each of the wash-step zones and out of the housing back to the loading/unloading area, wherein the drive means is operable to transport a shuttle from one set of shuttles independently of shuttles from each other set of shuttles.

The apparatus is a fully automated, unitary dishwashing apparatus.

In one embodiment, the housing comprises a wash zone, a rinse zone and a drying zone. The housing may further comprise a sanitation zone.

The apparatus may be configured such that delivery of washing and rinsing liquids and drying air to the respective wash-step zones is sufficiently localised within each zone that unwanted transmission of washing and rinsing liquids, or drying air, between zones is prevented or restricted to a level which does not impede performance of the dishwashing cycle. This may be achieved by delivering the washing and rinsing liquids and drying air by means of spray nozzles, the angles and pressures of the spray nozzles in each zone being configured to minimise cross contamination between wash-step zones.

Alternatively, each wash-step zone within the housing may be divided from adjacent zones by a physical partition to limit the transmission of washing and rinsing liquids, or drying air, between zones while permitting passage of loaded shuttles from one zone to the next. An example of a suitable partition is a plastic strip curtain. Where the wash-step zones are divided by partitions, they may be termed wash-step chambers.

The plurality of shuttles or carriers are disposed or arranged in sets or groups, each set comprising a plurality of like shuttles each of which is configured to receive and carry an individual item of one category of soiled tableware. Accordingly, the dishwashing apparatus comprises a set of shuttles each adapted to receive an individual item of plateware (e.g. plates, bowls and the like), a set of shuttles each adapted to receive an individual place-setting of cutlery and/or utensils (e.g. items of cutlery such as fork/spoon/knife and other kitchen utensils), and a set of shuttles each adapted to receive glassware and/or cupware.

The apparatus is configured with shuttles of like type arranged in rows, i.e. each set of shuttles comprises one row. In one embodiment, the apparatus comprises three rows of shuttles, a row of plateware shuttles, a row of cutlery shuttles and a row of glassware/cupware shuttles, each row containing shuttles purposely designed to accommodate an individual item of a different category of soiled tableware: e.g. one plate, one place-setting of cutlery (i.e. one or a few items of cutlery), or one glass.

The apparatus is adapted to quickly and efficiently wash as little as the soiled tableware generated by one person at one sitting there-and-then without a) waiting to fill the wash chamber of a conventional under the counter kitchen dishwasher, which may have capacity for a dozen or more place settings or b) running a conventional dishwashing machine with only a few items in it, which is wasteful of energy and detergent and slow. Shuttles configured to receive and carry single items and specifically adapted for plateware, cupware and cutlery/utensils permit the apparatus to efficiently wash just a few items in a quick wash cycle. Plateware and cupware shuttles are configured to receive and carry one individual item, e.g. a plate and a cup, respectively. A cutlery/utensil shuttle is capable of carrying one or a few items of cutlery, e.g. one or more items selected from a knife, a fork and a spoon, which may be used (i.e. made dirty) by a person at one sitting in a single meal or snack.

In another embodiment, the housing comprises an ingress flap for entry of a shuttle and an egress flap for exit of a shuttle.

Shuttles from each set of shuttles are operable to be transported through the apparatus independently of shuttles from each other set. This may be achieved by providing each set of shuttles with an independent drive means. In one embodiment, the drive means comprises a pair of track assemblies, each assembly comprising a rack and pinion drive mechanism in which a pinion is sandwiched between a movable rack in the form of a loop and a fixed rack which is not a complete loop.

The disclosed apparatus is adapted for rapidly cleaning one or a few soiled items as needed, without the need to accumulate sufficient items to fill a large wash chamber in order to justify the resources (energy, water, detergent, time) required to run a wash cycle in a conventional dishwashing machine.

Shuttles specifically adapted to receive one of plates/dishes, cutlery, and cups/glasses are convenient for loading and washing just one or a few table place settings at a time.

Because each set of shuttles is capable of being independently driven, the apparatus is adaptable to different dishwashing needs or occasions. For example, if a person ate a bowl of soup and did not take a drink with their meal, the bowl and spoon could be loaded in the a plateware shuttle and a cutlery shuttle respectively and driven through the housing for a wash cycle, while the cupware shuttle could be omitted from the cycle. If the person had a sandwich with their soup, the sandwich plate could be sent through the wash on a second plateware shuttle. Similarly, if two people take a meal together, a second place setting can be washed there and then by sending a further assortment of shuttles through the wash cycle, an so on.

The apparatus described herein can be installed on the counter next to the kitchen sink. In another embodiment, the apparatus is installed into the countertop so that the loading/unloading area atop the housing is substantially flush with the countertop, in similar location to a drainer of a conventional sink/drainer arrangement. The apparatus accepts the soiled item/items, drops them into the housing, washes, rinses, sanitizes, dries and returns the items stacked, ready to be reused, in a rapid time.

A simple drive mechanism transports the shuttles in a continuous circuit starting and finishing at the loading/unloading area on top of the apparatus housing and allows multiple items to be processed at short intervals. The prior art disadvantages of pre-rinsing, bending over, waiting for a full load, waiting for cycle to complete to be able to reuse the items are avoided. Dirty items in the kitchen sink, or counter, etc. are similarly avoided, resulting in a clean, de-cluttered kitchen.

In a further aspect, the invention provides a method for washing tableware, which comprises:

loading a soiled item of tableware into a shuttle located in a loading/unloading area atop a housing of a dishwashing apparatus, the shuttle being selected from a group of available shuttle types consisting of: a plateware shuttle configured to receive an individual item of plateware, a cutlery shuttle configured to receive an individual place-setting of cutlery, and a cupware shuttle configured to receive an individual item of cupware;

transporting the loaded shuttle through a series of zones contained in the housing, each zone adapted to perform a step of a dishwashing cycle, such that the soiled item is subjected to a full washing cycle;

transporting the loaded shuttle out of the housing and returning it to the loading/unloading area, wherein each type of shuttle is transported through the housing independently of each other type of shuttle.

As used herein, "tableware" includes any item used—and therefore dirtied—during consumption of a meal, such as the items usually included in a table place setting, i.e. plates, bowls, cutlery and cups and glasses. Items used in the preparation and serving of a meal are also included by the term. The term is therefore synonymous with the generic term "dishes" as used in the phrase "washing the dishes" and in the term "dishwasher" itself.

DESCRIPTION OF THE DRAWINGS

An embodiment of the invention shall now be described, by way of example, with reference to the drawings, of which.

DETAILED DESCRIPTION OF THE INVENTION

An embodiment of the invention shall now be described, by way of example, with reference to the accompanying figures.

Figure 1:
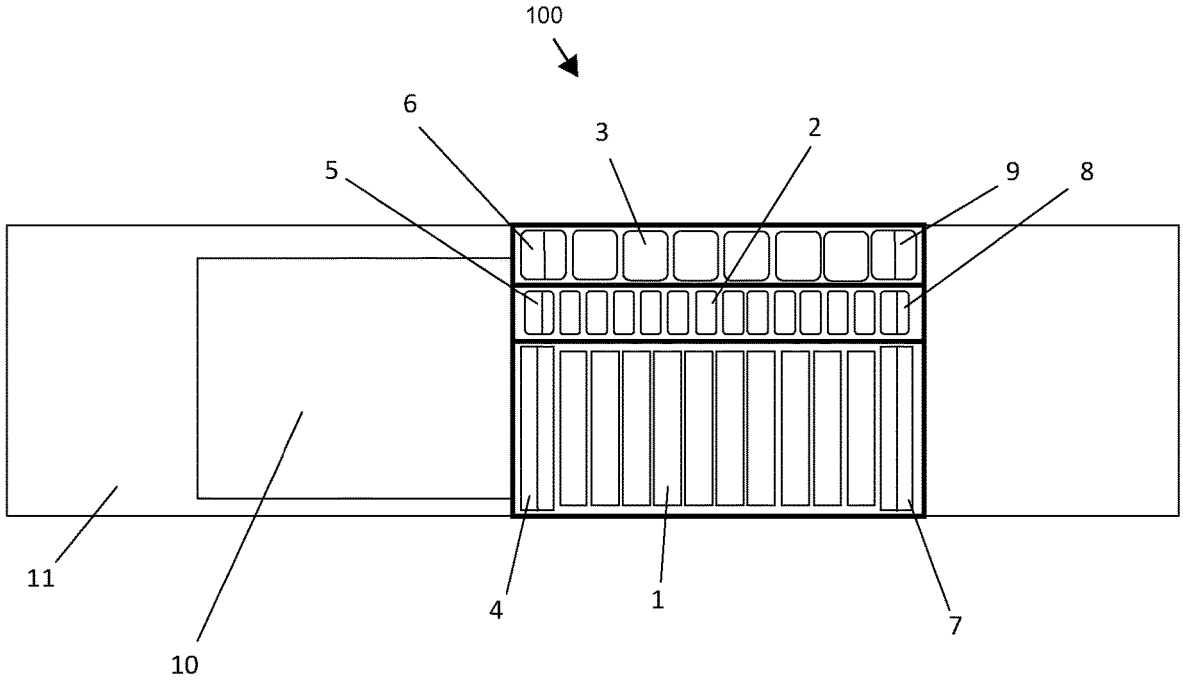
FIG. 1 is a diagram showing a top view of a dishwashing apparatus according to an embodiment of the invention.

With reference to FIG. 1, the apparatus 100 is installed next to a kitchen sink 10 with the top of the housing, which comprises the loading/unloading area, level with the countertop 11. Apparatus 100 includes three separate rows of shuttles: a row of plateware shuttles 1, each made in a shape capable of accepting and holding typical plateware; a row of cutlery shuttles 2, each adapted to receive one or a few typical items of cutlery; and a row of cupware shuttle 3, each adapted to receive a typical glass/cup. Each shuttle is supported by a transversal axle having a sprocket type gear at each end, which sit in their own respective tracks, allowing the shuttles 1, 2, 3 to travel through the apparatus independently.

Each of the shuttles 1, 2, 3, when loaded with a soiled item, travels down into the housing through respective ingress flaps 4, 5, 6, travels through successive wash-step zones and exits the housing through the egress flaps 7, 8, 9.

Figure 2:
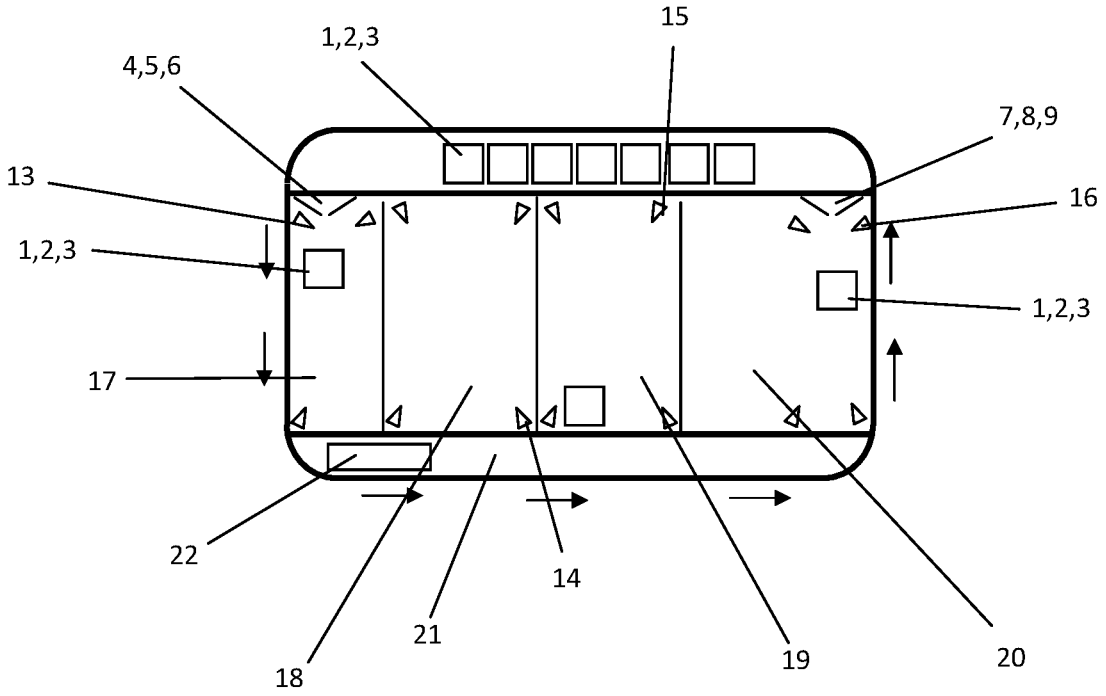
FIG. 2 is a diagram showing a side view of the dishwashing apparatus of FIG. 1 with front panel removed to show internal components.

As shown in FIG. 2, as each respective shuttle 1, 2, 3 enters the housing through the ingress flaps 4, 5, 6, they travel through four distinct zones, and processes.

The first zone is the wash zone 17 which applies a wash cycle as the shuttles travel through the zone. The items are sprayed with dish soap, stored on board in dish soap tank 39, from several movable or stationary jet spray nozzles 13 located at different points and aimed at the soiled item/items.

The second zone is the rinse zone 18, which sprays rinse water over the items from several movable or stationary jet spray nozzles 14, located at different points, aimed at the soiled item/items.

The third zone is the sanitation zone 19, which sprays heated water or steam, to sanitize the items, from several, either movable or stationary jet spray nozzles 15, located at different points, aimed at the item/items to be sanitized.

The final zone is a drying zone 20, which directs either heated or cool air onto the items from several either movable or stationary air nozzles 16, located at different points, aimed at the item/items to be dried.

The drain tub 21, located at the bottom of the apparatus serves as a receptacle for water and debris, as well as housing the motors, dish soap tank, water heaters, steamers, and valves, power supply, controllers, etc., and is equipped with a drain trap 22 for debris collection.

Figure 3:
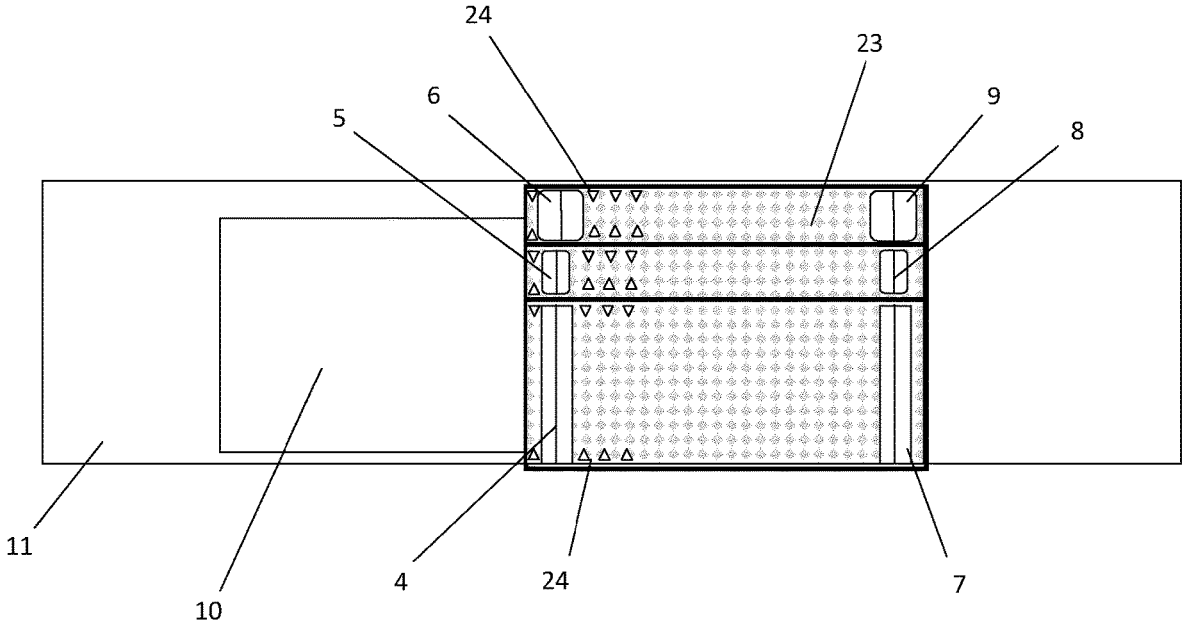
FIG. 3 is a diagram showing a top view of the dishwashing apparatus of FIG. 1 with the rack shuttles removed to expose the upper drain arrangement.

As shown in FIG. 3, the upper floor 23 of the apparatus which is located below the shuttles performs an additional role as a drain, as it allows discards and liquids to drain through this area and down into the housing and into the drain tub 21 below. This arrangement allows easy cleaning where the kitchen faucet can be used to rinse the entire shuttle rack area.

In order to keep this surface clean several spray nozzles 24 are located throughout this area.

Figure 4:
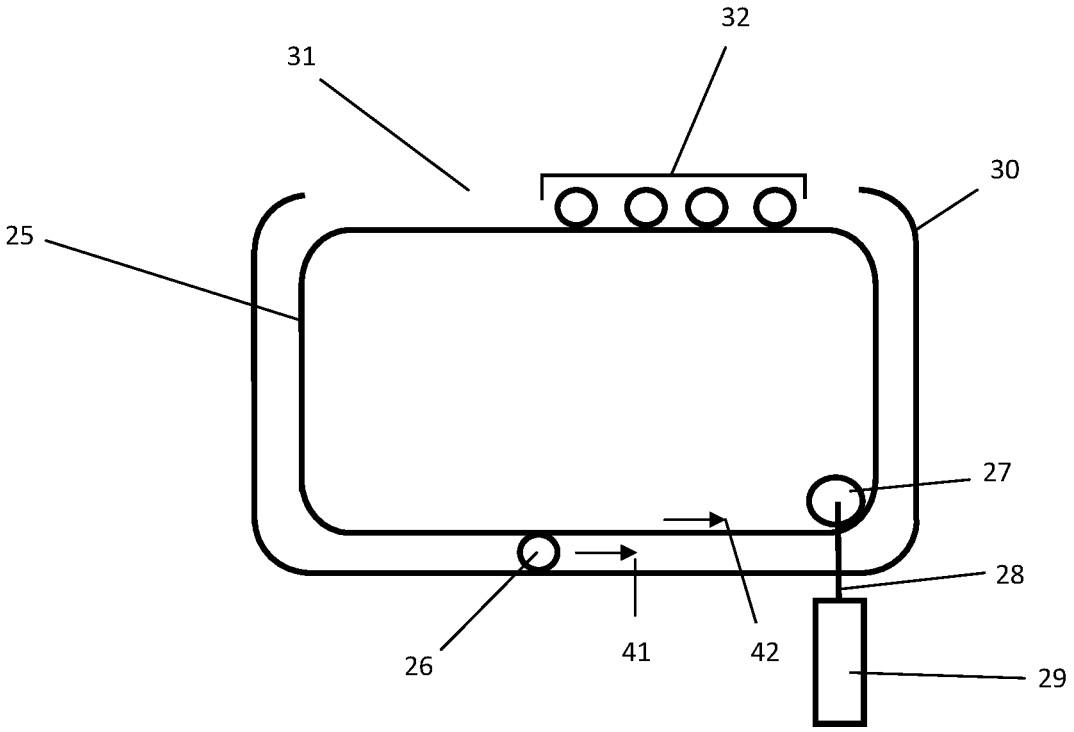
FIG. 4 is a diagram showing in side view the drive mechanism and components for transporting shuttles through the apparatus of FIG. 1.

The drive mechanism and components are shows in FIG. 4. The simple drive mechanism is made up of a pair of track assemblies, each consisting of a rack and pinion type drive mechanism, whereby the pinion 26 is sandwiched between two racks, one stationary or fixed rack 30 and one moveable drive rack or chain 25. The direction of travel of the moveable or drive chain 25, indicated by arrow 41, determines the direction of travel of the shuttles 1, 2, 3, indicated by arrow 42.

The drive chain is in turn driven by a reversable AC or DC electric motor 29 equipped with a worm gear 28, for braking purposes. A sprocket or a tension device 27 is used to grasp the drive chain and move it along its designated track 25.

The stationary track 30 does not create a complete loop but is terminated for a portion of the shuttle travel 31. This permits the shuttles to rack together 32, i.e., accumulate in a row, at the top of the apparatus and to remain in place even though the drive chain is moving. This results in each of the shuttles moving independently of the others.

Figure 5:
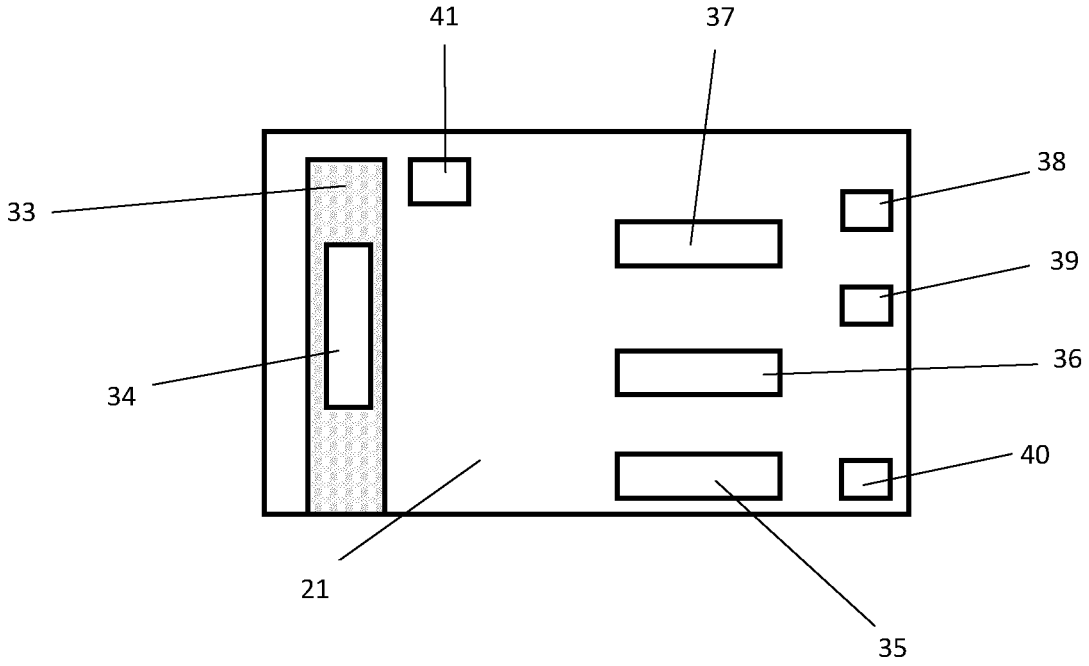
FIG. 5 is a diagram showing a top view of the interior drain pan and additional components of the apparatus of FIG. 1.

FIG. 5 shows the drain pan with additional internal components. The drain pan 21 receives all liquids and discards for disposal through the apparatus and into the municipal waste disposal system. A trap 33 for solids is provided so only liquids proceed into the drain 34.

Other components include drive motors 35, 36, 37, water heater/steamer 38, dish soap tank 39, power supply 41, and controller 40.

Operation of the disclosed apparatus will now be described.

Each of the shuttles 1, 2, 3 is provided with a pair of tracks which enables the shuttles 1, 2, 3 to be carried, in any combination, through each of the four process cycles, namely, washing, rinsing, sanitizing and drying. All without user intervention.

Each row of shuttles 1, 2, 3 operates independently of the other rows and shuttles, thus permitting each work item to proceed through the apparatus independently of the other items, allowing an "as needed" operation.

A grill in the upper floor 23 below the all of the shuttles 1, 2, 3 permits debris to flow through the apparatus and into the lower drain pan 21 inside of the apparatus.

As a soiled item is placed in its specific shuttle receptacle 1, 2 or 3, the shuttle descends into the housing and begins its progress through the wash-step zones.

An ingress flap 4, 5, 6 for each row allows the shuttle 1, 2, 3 to enter into the apparatus.

Wash step 1: as the shuttle 1, 2, 3 travels through the wash zone 17 the work (soiled item) in the shuttle 1, 2, 3 is sprayed with dishwashing soap from the spray nozzles 13 located underneath the grill, as well as the floor of the zone.

Wash step 2: as the shuttle 1, 2, 3 continues to travel through the apparatus it enters the rinse zone 18 and the second cycle begins, where fresh clean water is sprayed onto the work in the shuttle, from other spray nozzles 14 located underneath the grill, as well as the floor of the zone.

Wash step 3: as the shuttle 1, 2, 3 continues to travel through the apparatus it enters the sanitation zone 19 where the third stage cycle begins, where heated water or steam is sprayed onto the surface of the work in the shuttle as a sanitizing stage.

Wash step 4: as the shuttle 1, 2, 3 continues to travel through the apparatus it enters the drying zone 20 and the fourth and final stage, the drying cycle, begins, where hot air or ambient air is blown over the surface of the work in the shuttle, as a drying and cooling process.

At this point the shuttle 1, 2, 3 continues to travel back to the top surface of the apparatus through an egress flap 7, 8, 9, where the shuttle 1, 2, 3 is left to free roll and stack up behind the other respective shuttles on the exposed top portion of the housing (loading/unloading area) ready for unloading and reuse.

The invention claimed is:

1. A dishwashing apparatus comprising:

a housing containing a series of zones, each zone adapted for performing a step of a dishwashing cycle;

a loading/unloading area atop the housing;

a plurality of shuttles for receiving and conveying soiled items, the shuttles arranged in rows, each row containing shuttles of a different type to each other row, the rows comprising:

a row of plateware shuttles, each plateware shuttle configured to receive and carry an individual item of plateware, a row of cutlery shuttles, each cutlery shuttle configured to receive and carry an individual place-setting of cutlery and/or utensils, a row of cupware shuttles, each cupware shuttle configured to receive and carry an individual item of cupware;

and a drive means comprising a plurality of independently operable drive mechanisms, each of said drive mechanisms configured for transporting a shuttle from one of said rows of shuttles in a loop from the loading/unloading area, through an ingress flap into the housing, through each zone, and through an egress flap out of the housing back to the loading/unloading area, wherein the drive means is operable to transport a shuttle from one row of shuttles independently of other shuttles from the same row and independently of shuttles from each other row of shuttles, and wherein each drive mechanism is configured to permit a shuttle that is transported out of the housing to free roll and stack up in a row with shuttles of like type in the loading/unloading area.

2. The apparatus of claim 1, in which the series of zones comprises a wash zone, a rinse zone and a drying zone.

3. The apparatus of claim 2, in which the series of zones further comprises a sanitation zone.

4. The apparatus of claim 1, in which each zone is separated from adjacent zones by a physical barrier, said physical barrier being displaceable to permit passage of one or more shuttles selected from a plateware shuttle, a cutlery shuttle and a cupware shuttle therethrough.

5. The apparatus of claim 1, in which each drive mechanism comprises a pair of track assemblies, each track assembly comprising a rack and pinion drive mechanism in which a pinion is sandwiched between a movable rack in the form of a loop and a fixed rack which is not a complete loop, permitting shuttles to rack together and remain in place at the loading/unloading area even when the movable rack is moving.

6. A method for washing tableware, which comprises:

loading a soiled item of tableware into a shuttle located in the loading/unloading area atop the housing of a dishwashing apparatus according to claim 1;

transporting the loaded shuttle through the series of zones contained in the housing, such that the soiled item is subjected to a full washing cycle;

transporting the loaded shuttle out of the housing and returning it to the loading/unloading area, wherein each type of shuttle is transported through the housing independently of each other type of shuttle.

* * * * *